US006907712B2

(12) United States Patent
Garfinkle

(10) Patent No.: US 6,907,712 B2
(45) Date of Patent: Jun. 21, 2005

(54) PROTECTIVE FREIGHT ENCLOSURE

(76) Inventor: Jeffrey Garfinkle, 56 W. 85th St., Suite 9, New York, NY (US) 10024

( * ) Notice: Subject to any disclaimer, the term of this patent is extended or adjusted under 35 U.S.C. 154(b) by 100 days.

(21) Appl. No.: 10/112,233

(22) Filed: Mar. 28, 2002

(65) Prior Publication Data

US 2002/0096516 A1 Jul. 25, 2002

Related U.S. Application Data

(63) Continuation-in-part of application No. 09/568,113, filed on May 10, 2000, now abandoned.

(51) Int. Cl.[7] ..... B65B 13/02; B65D 65/02

(52) U.S. Cl. ..... 53/399; 53/397; 150/154

(58) Field of Search ..... 53/397, 399, 416, 53/447, 449, 485, 176; 206/597, 600, 386; 150/154, 158

(56) References Cited

U.S. PATENT DOCUMENTS 1,315,794 A * 9/1919 Richards ..... 150/154
2,166,594 A * 7/1939 Jenks ..... 206/597
2,445,152 A * 7/1948 Poole ..... 206/597
2,455,237 A * 11/1948 Davis ..... 150/154
2,614,689 A * 10/1952 Miller ..... 206/600
3,659,641 A * 5/1972 Marino ..... 206/597
3,990,576 A * 11/1976 Heaney ..... 206/453
4,878,334 A * 11/1989 Quinn ..... 53/399
5,497,819 A * 3/1996 Chiang ..... 150/166
5,511,655 A * 4/1996 Porter ..... 150/154
5,772,369 A * 6/1998 Lerman et al. ..... 206/597
5,983,598 A * 11/1999 Quinones ..... 53/449
6,540,085 B1 * 4/2003 Davies ..... 206/597

* cited by examiner

*Primary Examiner*—Louis Huynh
(74) *Attorney, Agent, or Firm*—McAndrews, Held & Malloy, Ltd.

(57) ABSTRACT

A freight protection apparatus is disclosed which includes an enclosure for protecting freight shaped in the from of an open box, having an opening, first, second, third, and fourth sides, and a top portion, which enclose a chamber. The enclosure may have attached to it first and second straps which can be used to securely attach the enclosure to freight or to a collection of freight. The first and second straps each may have a first end which is in the form of a loop and a second end which is attached to an attachment device. The first and second straps can be connected together to attach the enclosure to the freight. First and second metal plates may be provided to further prevent the enclosure from being separated from the collection of freight. Locks with unique serial numbers may be provided for locking the first and second straps together. A method is disclosed comprising placing such an enclosure over a collection freight, and securing said enclosure to said freight.

8 Claims, 4 Drawing Sheets

PROTECTIVE FREIGHT ENCLOSURE

CROSS REFERENCE TO RELATED APPLICATION

This application is a continuation in part of and claims the priority of U.S. patent application Ser. No. 09/568,113 filed on May 10, 2000, now abandoned.

FIELD OF THE INVENTION

This invention relates to improved methods and apparatus concerning providing protection for freight.

BACKGROUND OF THE INVENTION

Typically in the prior art freight is protected by sheets of plastic which are easy to cut and/or tamper with, without detection. Such sheets of plastic are also not particularly durable.

SUMMARY OF THE INVENTION

A freight protection apparatus and method is disclosed. The apparatus may include an enclosure for protecting freight shaped in the from of an open box, having an opening, and having first, second, third, and fourth sides, and a top portion, which enclose a chamber. The enclosure may have attached to it first and second straps which can be used to securely attach the enclosure to a collection of freight located, for example, on a pallet. Each of the first and second straps may have a first end which may be in the form of a loop and a second end which may be attached to an attachment device. The loop from the first strap can be connected to an attachment device fixed to the second strap and the loop from the second strap can be connected to an attachment device fixed to the first strap. In this manner the first and second straps can be connected together.

First and second metal plates may be provided to further prevent the enclosure from being separated from the collection of freight and/or the pallet. The first metal plate may be attached to one of the first, second, third, or fourth sides. The second metal plate, may be attached to one of the first, second, third, or fourth sides which is opposite the side where the first metal plate is attached.

The first strap may be inserted through one or more sleeves attached to one or more sides of the enclosure. Similarly the second strap may be inserted through one or more sleeves attached to one or more sides of the enclosure. Locks with unique serial numbers may be provided for locking the loop ends of the first and second straps to the appropriate attachment device.

The present invention also discloses in one embodiment a method comprising the steps of placing an enclosure shaped in the from of an open box, having an opening, and having first, second, third, and fourth sides, and a top portion, which enclose a chamber; over freight which is located on top of a pallet. The enclosure may have first and second straps attached to it similar to as previously mentioned.

DETAILED DESCRIPTION OF THE DRAWINGS

Figure 1A:
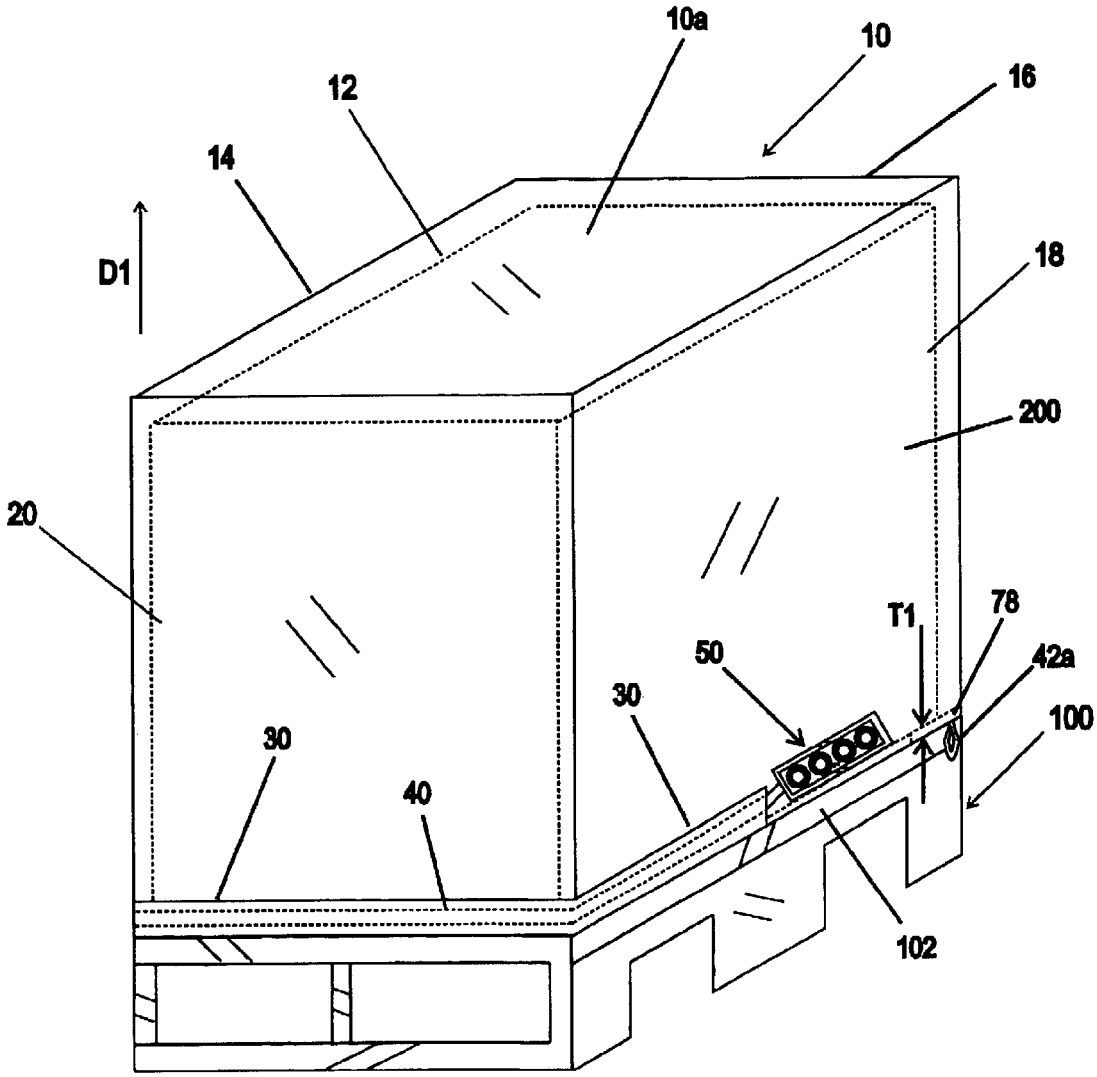
FIG. 1A shows a first perspective view of an apparatus in accordance with an embodiment of the present invention along with a first perspective view of a pallet and the location of a freight box with a first plate of the apparatus inserted between the freight box and the pallet.
Figure 1B:
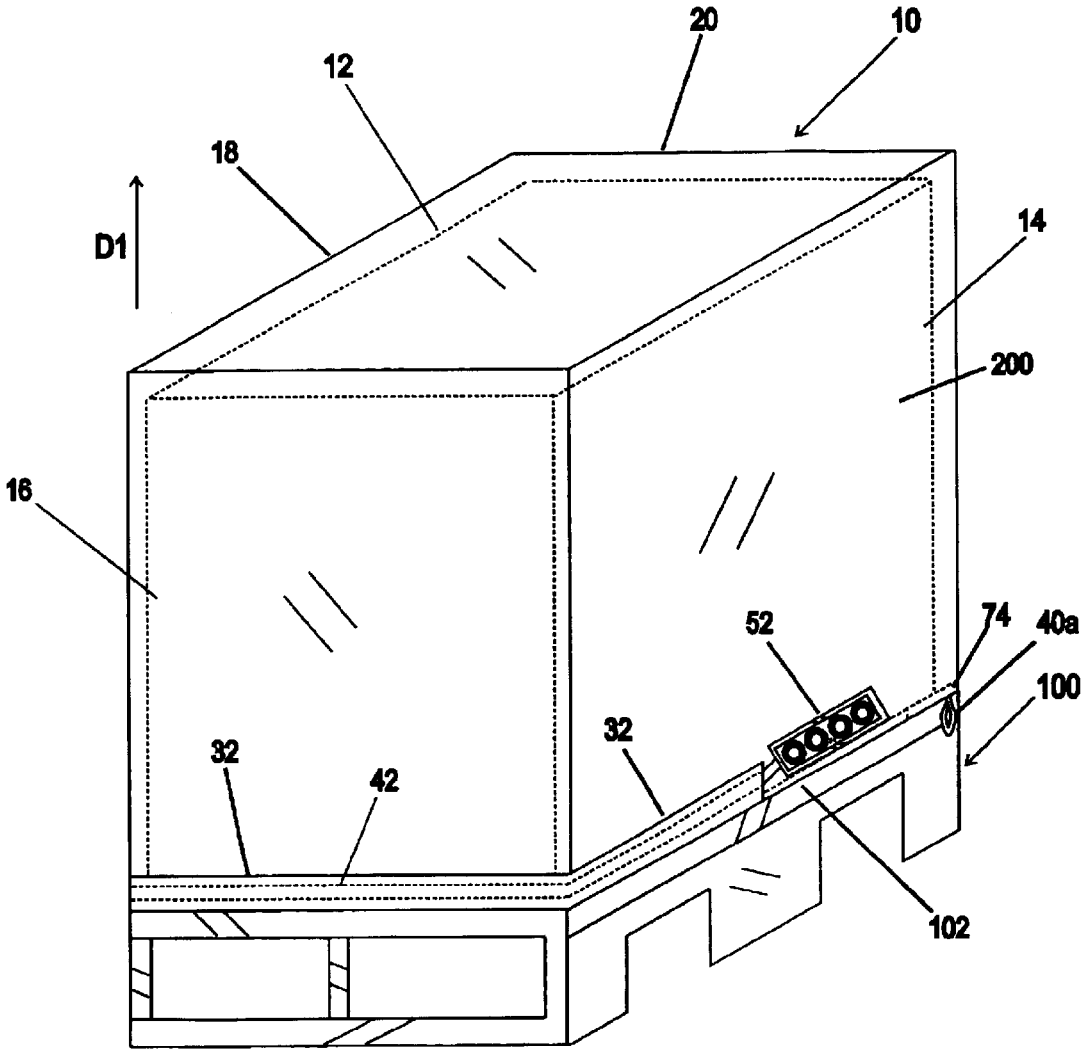
FIG. 1B shows a second perspective view of the apparatus of FIG. 1A and a second perspective view of the pallet of FIG. 1A and the location of a freight box with a second plate of the apparatus inserted between the freight box and the pallet.
Figure 2:
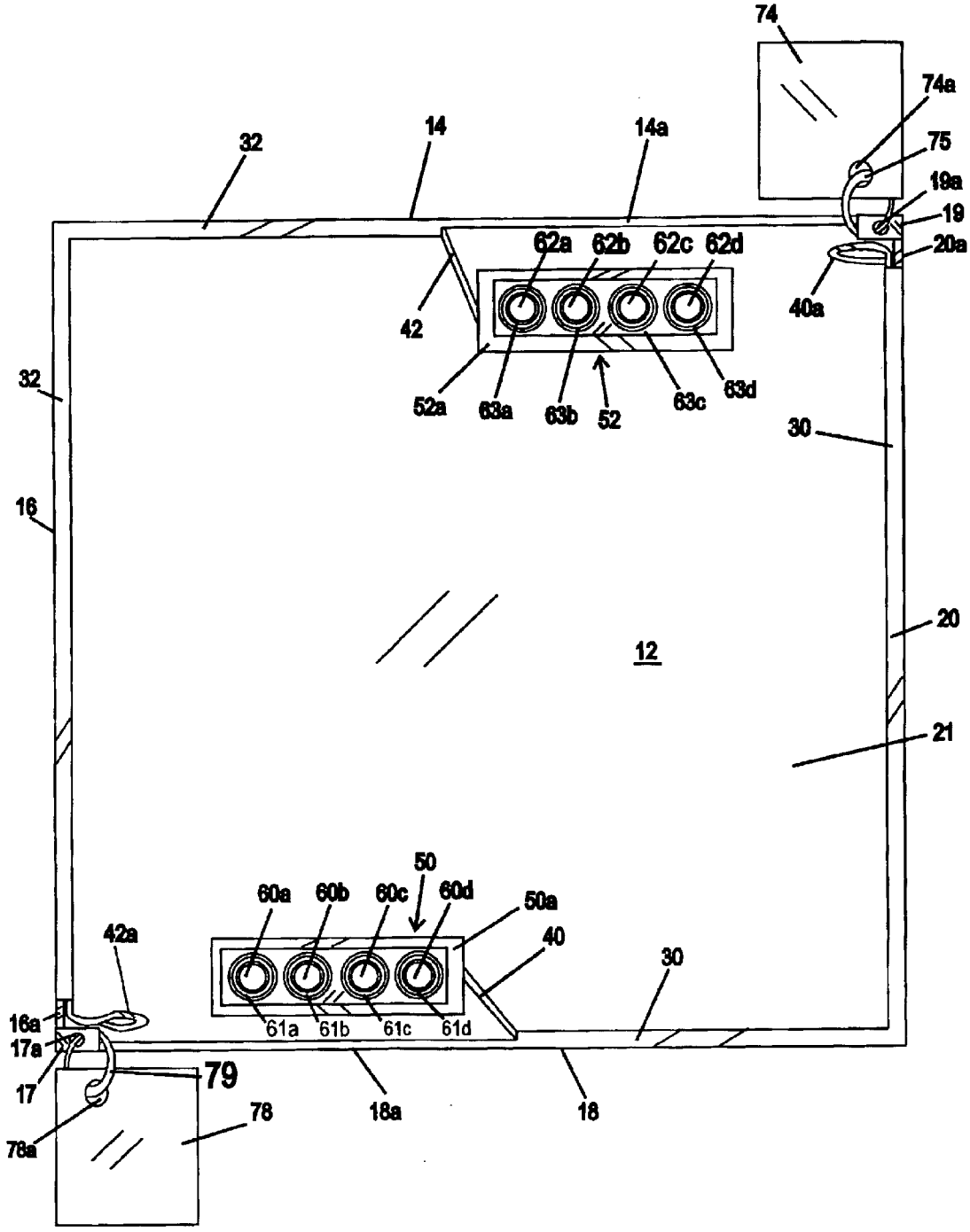
FIG. 2 shows a bottom view of the apparatus of FIG. 1A.

FIG. 1A shows a first perspective view of an apparatus 10 in accordance with an embodiment of the present invention along with a first perspective view of a pallet 100 and the location of a freight box 200 with a first plate 78 of the apparatus 10 inserted between the freight box 200 and the pallet 100. FIG. 1B shows a second perspective view of the apparatus 10 of FIG. 1A and a second perspective view of the pallet 100 of FIG. 1A and the location of a freight box 200 with a second plate 74 of the apparatus 10 inserted between the freight box 200 and the pallet 100. FIG. 2 shows a bottom view of the apparatus 10 of FIG. 1A.

The apparatus 10 has a top portion 12, and sides 14, 16, 18, and 20. The top portion 12 and sides 14, 16, 18, and 20 may be said to define an enclosure having an opening. The enclosure may be said to enclose a chamber 10*a* defined by top portion 12, and sides 14, 16, 18, and 20. Inside the chamber 10*a* is located a freight box 200. The freight box 200 may be, for example, a box for a refrigerator or a box for an oven or any other box holding any other type of goods or freight. The freight box 200 may be replaced by any other type of freight such as a plurality of smaller freight boxes.

The apparatus 10 also includes straps 40 and 42. Each of the straps 40 and 42 may be a rope, a cord, a strap, or a similar device. The strap 40 is fixed, at its first end, to an attachment device 50, as shown in FIG. 1A. The strap 42 is fixed at its first end, to an attachment device 52, as shown in FIG. 1B. Most of the strap 40 is shown in dashed lines and lies inside of a sleeve 30 which is fixed at the bottom of sides 20 and 18 as shown in FIG. 1A. Most of the strap 42 lies inside of a sleeve 32 which is fixed at the bottom of sides 16 and 14 as shown in FIG. 1B. The strap 40 ends in a loop 40*a* at the second end of the strap 40, as shown in FIG. 1B. Similarly the strap 42 ends in a loop 42*a* at the second end of the strap 42, as shown in FIG. 1A.

As shown in FIG. 2, the attachment device 52 includes openings 62*a*, 62*b*, 62*c*, and 62*d* formed in rings 63*a*, 63*b*, 63*c*, and 63*d*. Similarly, the attachment device 50 includes openings 60*a*, 60*b*, 60*c*, and 60*d* formed in rings 61*a*, 61*b*, 61*c*, and 61*d*. Each of the rings 61*a–d* and 63*a–d* may be metal rings. Each of the rings 61*a–d* and each of the rings 63*a–d* are fixed to a base material 50*a* and 52*a*, respectively, of the attachment devices 50 and 52, respectively. Each of the rings 61*a–d* and 63*a–d* may be comprised of three sections, which may be an outer section, a middle section, and an inner section. The sides 14, 16, 18, and 20, the top portion 12, and the base material 50*a* and 52*a* may be made of the same material which may be TYVEK (trademarked) or any other water resistant and/or durable material.

In FIG. 2, a ring 75 is shown inserted through a hole 74*a* in the plate 74, and the ring 75 is thereby connected to the plate 74. Similarly a ring 79 is shown inserted through a hole 78*a* in the plate 78, and the ring 79 is thereby connected to the plate 78. The ring 75 is also shown inserted into a hole 19*a* in a sleeve 19. The sleeve 19 is fixed to the sides 14 and 20 of the apparatus 10. Similarly, the ring 79 is also shown inserted into a hole 17*a* in a sleeve 17. The sleeve 17 is fixed to the sides 16 and 18 of the apparatus 10.

In operation, an individual would place the apparatus 10 over freight, such as the freight box 200, which is sitting on the pallet 100, so that the freight is completely covered by the apparatus 10. In this manner the apparatus 10 is positioned as in FIGS. 1 and 2. The apparatus 10 has an open end 21 whose location is shown in FIG. 2, which is like the open end of an open box. The plates 74 and 78 are then slid under the freight box 200, substantially at the corners of the apparatus 10 as shown in FIGS. 1A and 1B. Each of the plates 74 and 78 may have a thickness, T1 shown in FIG. 1A, of ⅛ (one eighth) of an inch.

Figure 3A:
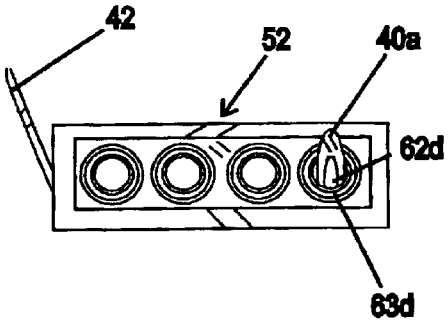
FIG. 3A shows a first attachment device of the apparatus of FIG. 1A with a first loop inserted into a first ring of the first attachment device.
Figure 3B:
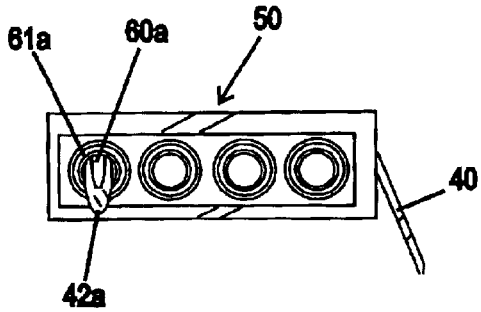
FIG. 3B shows a second attachment device of the apparatus of FIG. 1A with a second loop inserted into a first ring of the second attachment device.
Figure 4A:
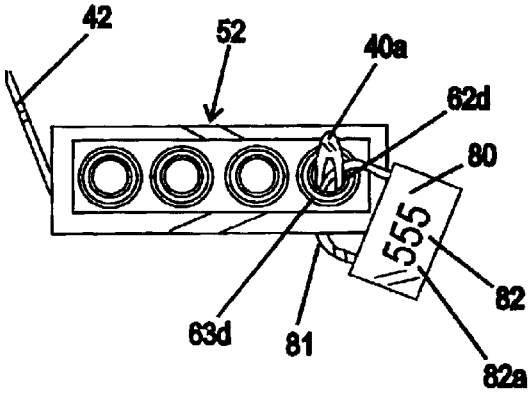
FIG. 4A shows a first lock which has been inserted into the first loop and the first ring of the first attachment device so that the first loop is attached to the first attachment device.
Figure 4B:
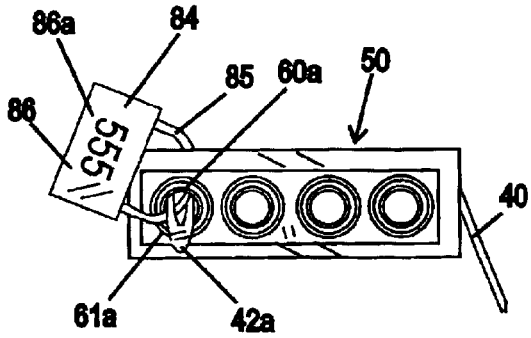
FIG. 4B shows a second lock which has been inserted into the second loop and the first ring of the second attachment device so that the second loop is attached to the second attachment device.

The individual would then insert loop 40*a* into one of the openings 62*a–d* of the attachment device 52, such as into opening 62*d* as shown in FIG. 3A. Similarly, the individual would insert loop 42*a* into one of the openings 60*a–d* of the attachment device 50, such as into opening 60*a* as shown in FIG. 3B. The individual would then insert a loop 81 of a lock 80 through the loop 40*a* and the opening 62*d* so that the strap 40 is connected to the attachment device 52 at the end where loop 40*a* is located, as shown in FIG. 4A. The loop 81 would be pressed into the base 82 to lock the lock 80. Similarly the individual would insert a loop 85 of a lock 84 through the loop 42*a* and the opening 60*a* so that the strap 42 is connected to the attachment device 50 at the end where loop 42*a* is located, as shown in FIG. 4B. This causes the straps 40 and 42 to be connected together and tightened so that the sides 14, 16, 18 and 20 fit snugly around the perimeter of the freight box 200.

Locks 80 and 84 have serial numbers 82*a* and 86*a*, respectively, which are both "555". This can be used as an identification number for the particular freight box 200 or the pallet 100. The pallet 100 may be any type of pallet having and may have a base 102.

The apparatus 10 protects freight, such as freight box 200 lying within the chamber 10*a* enclosed by top 12, and sides 14, 16, 28, and 20 from water damage, from theft, and from the high insurance costs associated with water damage and theft. The apparatus 10 is made of durable, lightweight, resistant material such as TYVEK (trademarked). The apparatus 10 is typically one piece. The apparatus 10 protects freight far better than typical plastic wrappings. Plastic wrappings may allow water to penetrate the freight. Further plastic wrappings are easy for a thief to open and to steal from and to reapply plastic wrapping without detection.

The locks 80 and 84, typically have to be broken for a thief to obtain access to the freight box 200 inside the apparatus 10. If the locks 80 or 84 are broken it provides evidence of tampering of the freight box 200 and/or the apparatus 10. In one embodiment of the present invention, the locks 80 and 84 are of the form such that once they are opened, they cannot be resealed. In accordance with an embodiment of the present invention, each pallet or each collection of freight on a pallet, may have it own apparatus 10 and at least one lock, like lock 80 or 84, with a unique serial number.

Because tampering can easily be detected, an insurance company can easily determine when the apparatus 10 was tampered with and if necessary, appropriately ascertain liability for the damage to the freight. The apparatus 10 acts as an effective deterrent against would be thieves.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method of protecting freight from theft or damage comprising the steps of:

(1) placing a flexible, durable cover over freight which is located on top of a pallet, the cover having a top portion and first, second, third and fourth sidewalls joined at their upper ends to the top portion and joined at their respective sides to an adjacent sidewall so that the top portion and sidewalls together form an open box-shaped structure which fits over and covers the freight, each of the sidewalls also having a bottom edge which lies adjacent to the pallet when the cover is placed over the freight;

(2) tightening the cover to the freight by pulling to a desired tightness a first strap positioned along the bottom edge of at least the first sidewall, and a second strap positioned along the bottom edge of at least the third sidewall, the first strap having a first end connected to an attachment device and a second end terminating in a loop, the second strap having a first end connected to an attachment device and a second end terminating in a loop, wherein the attachment devices of the first and second straps each comprises a handle having a plurality of spaced apart ringed openings therethrough;

(3) maintaining the desired tightness of the first and second straps by inserting the loop of the first strap through one of the ringed openings in the handle of the second strap, and by inserting the loop of the second strap through one of the ringed openings in the handle of the first strap;

(4) inserting a first tamper-resistant lock through the loop of the first strap and the ringed opening in the handle of the second strap and locking the first lock; and (4) inserting a second tamper-resistant lock through the loop of the second strap and the ringed opening in the handle of the first strap and locking the second lock.

2. The method of claim 1 wherein the first strap is inserted through a first sleeve which is attached to at least the first sidewall along the bottom edge thereof.

3. The method of claim 1 wherein the first strap is inserted through a first sleeve which is attached to at least the first sidewall along the bottom edge thereof, and the second strap is inserted through a second sleeve which is attached to at least the third sidewall along the bottom edge thereof.

4. The method of claim 1 further including the steps of attaching a first ring to one of the sidewalls of the cover, attaching a first plate to the first ring, and sliding the first plate between the freight and the pallet to prevent the cover from being separated from the freight and the pallet.

5. The method of claim 4 further including the steps of attaching a second ring to another of the sidewalls of the cover, attaching a second plate to the second ring and sliding the second plate between the freight and the pallet.

6. A method of enclosing freight within a cover to protect the freight from theft or damage, the cover comprising a top portion and first, second, third and fourth sidewalls made from a flexible, durable material, the sidewalls being joined at their upper ends to the top portion and joined at their respective sides to an adjacent sidewall so that the top portion and sidewalls together form an open box-shaped structure which fits over and covers the freight, each of the sidewalls also including a bottom edge, the method comprising the steps of:

(1) placing the cover over the freight, which is located on top of a pallet, so that the bottom edges of the sidewalls lie adjacent to the pallet;

(2) tightening the cover to the freight by pulling to a desired tightness a first strap positioned along the bottom edge of at least the first sidewall, and a second strap positioned along the bottom edge of at least the third sidewall, the first strap having a first end connected to an attachment device and a second end terminating in a loop, the second strap having a first end connected to an attachment device and a second end terminating in a loop, wherein the attachment devices of the first and second straps each comprises a handle having a plurality of spaced apart ringed openings therethrough;

(3) maintaining the desired tightness of the first and second straps by inserting the loop of the first strap through one of the ringed openings in the handle of the second strap, and by inserting the loop of the second strap through one of the ringed openings in the handle of the first strap;

(4) inserting a first tamper-resistant lock through the loop of the first strap and the ringed opening in the handle of the second strap and locking the first lock; and (4) inserting a second tamper-resistant lock through the loop of the second strap and the ringed opening in the handle of the first strap and locking the second lock.

7. The method of claim 6 further including the steps of attaching a first ring to one of the sidewalls of the cover, attaching a first plate to the first ring, and sliding the first plate between the freight and the pallet to prevent the cover from being separated from the freight and the pallet.

8. The method of claim 7 further including the steps of attaching a second ring to another of the sidewalls of the cover, attaching a second plate to the second ring and sliding the second plate between the freight and the pallet.

* * * * *